US005846177A

United States Patent [19]

Mayr

[11] Patent Number: 5,846,177

[45] Date of Patent: Dec. 8, 1998

[54] FOLDING MECHANISM CYLINDER HAVING AN ADJUSTABLE DIAMETER

[75] Inventor: Reinhard Mayr, Augsburg, Germany

[73] Assignee: MAN Roland Druckmaschinen AG, Offenbach am Main, Germany

[21] Appl. No.: 602,912

[22] Filed: Feb. 16, 1996

[30] Foreign Application Priority Data

Feb. 22, 1995 [DE] Germany ..... 295 02 957.9

[51] Int. Cl.[6] ..... B41F 13/62; B41F 33/00

[52] U.S. Cl. ..... 493/424; 493/475; 493/476

[58] Field of Search ..... 493/424–434, 493/478, 475, 476

[56] References Cited

U.S. PATENT DOCUMENTS

| | | | |
|---|---|---|---|
| 3,477,709 | 11/1969 | Neal | 493/424 |
| 4,075,896 | 2/1978 | Pessina | 493/424 |
| 4,380,449 | 4/1983 | Michalik | 493/424 |
| 5,000,433 | 3/1991 | Prum | 493/424 |
| 5,039,076 | 8/1991 | Fischer | 493/424 |
| 5,057,064 | 10/1991 | Michalik | 493/424 |
| 5,201,701 | 4/1993 | Roettger | 493/425 |
| 5,215,014 | 6/1993 | Burger | 493/424 |
| 5,313,883 | 5/1994 | DiGenova | 101/247 |
| 5,429,578 | 7/1995 | Calbrix | 493/424 |
| 5,507,714 | 4/1996 | Furuta | 493/424 |

FOREIGN PATENT DOCUMENTS

| | | |
|---|---|---|
| 1068728 | 11/1959 | Germany . |
| 1132564 | 7/1962 | Germany . |
| 2011661 | 7/1971 | Germany . |
| 1611330 | 2/1972 | Germany . |
| 2309919 | 9/1974 | Germany . |
| 2530365 | 1/1977 | Germany . |
| 3217169 | 11/1985 | Germany . |
| 3821442 | 1/1989 | Germany . |
| 3906975 | 3/1989 | Germany . |
| 3838314 | 5/1990 | Germany . |
| 9115526 | 4/1992 | Germany . |
| 4103160 | 8/1992 | Germany . |

*Primary Examiner*—John Sipos
*Assistant Examiner*—Christopher W. Day
*Attorney, Agent, or Firm*—Cohen, Pontani, Lieberman & Pavane

[57] ABSTRACT

A folding mechanism cylinder having a diameter that can be adjusted during operation of the cylinder. Adjustable bands are arranged on the outer jacket of the cylinder and are moved by rotation of spindles that are connected to the bands by gears. One of the spindles is arranged in the hollow shaft of the cylinder and drives all the other spindles.

13 Claims, 6 Drawing Sheets

FOLDING MECHANISM CYLINDER HAVING AN ADJUSTABLE DIAMETER

BACKGROUND OF THE INVENTION

1. Field of the Invention

The invention is directed to a cylinder in a folding mechanism whose diameter can be changed, while the cylinder is running, by adjustment of strips arranged on its jacket. The strips are adjusted by a superimposing gear unit and adjusting means which are arranged in the cylinder to displace one of the end edges of the strips.

2. Description of the Prior Art

A device for adjusting the diameter of a cylinder in a folding mechanism is already known from DE 38 21 442 C2. This known cylinder has a plurality of strips on its circumference, whose end edges are arranged in a stationary manner on one side and are articulated on the other side so as to be movable so that these ends can be displaced tangentially with respect to the circumference of the cylinder. The displacement of the suspensions is effected at the same time and in the same direction in all strips so that the strips are curved outward to a greater degree when the end edges move toward one another and the curvature of the strips is reduced when the end edges move away from one another so that the strips are stretched. This action permits the effective circumference of the cylinder to be adjusted. Such a possibility for adjusting the diameter of the cylinder is necessary for processing folded products of different thickness. In order to ensure a fast change from one thickness of folded product to another, the known cylinder can be adjusted while in operation. The movement required for adjusting the end edges of the strips is superimposed on the rotational movement of the cylinder by a differential gear. The movement of the differential gear is transmitted to the strips via a sun wheel which is arranged at the end side of the cylinder and rotates concentrically to the shaft of the cylinder but is not connected with the shaft, and via other toothed wheels and sliding plates. A disadvantage in the known device is that the arrangement of the sun wheel at the end side of the cylinder occupies considerable space and interferes with accessibility to the cylinder.

A folding jaw cylinder whose folding jaws are adjustable by means of a motor while the cylinder is running is known from DE 38 38 314 A1. This folding jaw cylinder has a first spindle which is arranged in its shaft so as to be rotatable and which drives a second spindle via a first bevel gear unit. The second spindle extends in the radial direction within the folding jaw cylinder and drives, via a second bevel gear unit, a third spindle which extends parallel to the longitudinal axis of the cylinder and adjusts the movable folding jaws.

SUMMARY OF THE INVENTION

Accordingly, it is an object of the present invention to provide a cylinder for a folding mechanism whose diameter can be adjusted in a simple and space-saving manner while the cylinder is running.

Pursuant to this object, and others which will become apparent hereafter, one aspect of the present invention resides in an adjustable diameter cylinder for a folding mechanism, which cylinder includes a cylinder body formed as a hollow shaft which has a longitudinal axis and a cylinder jacket. Strips are movably arranged on the cylinder jacket while a first spindle is provided in the hollow shaft. A superimposing gear unit rotatably drives the first spindle. Further spindles are arranged in the cylinder body so as to be rotatable, the strips being connected to these further spindles. The first spindle is connected to the further spindle so that rotation of the first spindle imparts rotation to the further spindles which in turn move the strips in a transverse manner while the cylinder is in operation, so as to adjust the cylinder diameter.

In a further embodiment of the invention the superimposing gear is provided as either a planetary gear or a differential gear.

In still another embodiment of the invention the further spindles include a second spindle arranged radially in the shaft. The first spindle is drivingly connected to the second spindle by a first bevel gear means. In yet another embodiment of the invention the second spindle has an interior region formed as a threaded sleeve. The further spindles include a threaded third spindle which is operatively engaged in the threaded sleeve so as to transform rotational movement of the radial second spindle into a transverse lifting movement of the threaded third spindle.

In still an additional embodiment of the invention the further spindles include a fourth spindle arranged below the jacket surface so as to extend parallel to the longitudinal axis of the cylinder. A lever is connected at one end to the fourth spindle and at another end to a chain link. A second end of the chain link is connected to the threaded third spindle so that the lifting movement of the threaded third spindle is transmitted via the chain link and the lever to the fourth spindle.

Another embodiment of the invention provides connecting links slidably supported in the cylinder body below the jacket surface, as well as cam means connected between the fourth spindle and the connecting links for transforming rotational movement of the fourth spindle into sliding movement of the connecting links. The strips are fastened to the connecting links at sliding end edges of the strips.

In a further variation of the invention the end edges of the strips are fastened to the fourth spindle so that rotational movement of the fourth spindle can be transformed into pulling and pushing motion of the strips.

Yet an additional embodiment of the invention provides additional spindles arranged below the jacket so as to extend parallel to the longitudinal axis of the cylinder. A number of the strips are associated with each of the additional spindles. A transmitting disk is arranged at one end of the cylinder and is connected to the fourth spindle and the additional spindles so that rotational movement of the fourth spindle is transmitted to the additional spindles.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
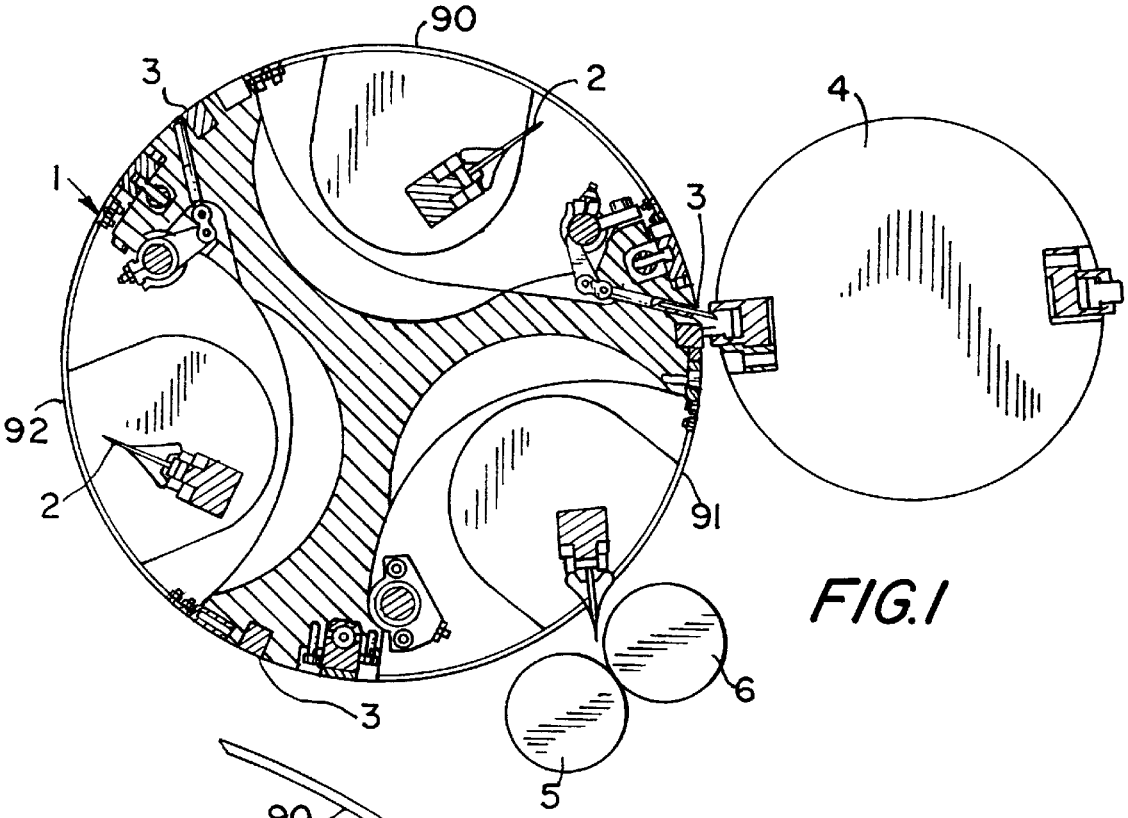
FIG. 1 shows a cross-sectional view of a collecting and folding-blade cylinder cooperating with a cutting cylinder and two folding rollers, pursuant to the present invention.
Figure 2:
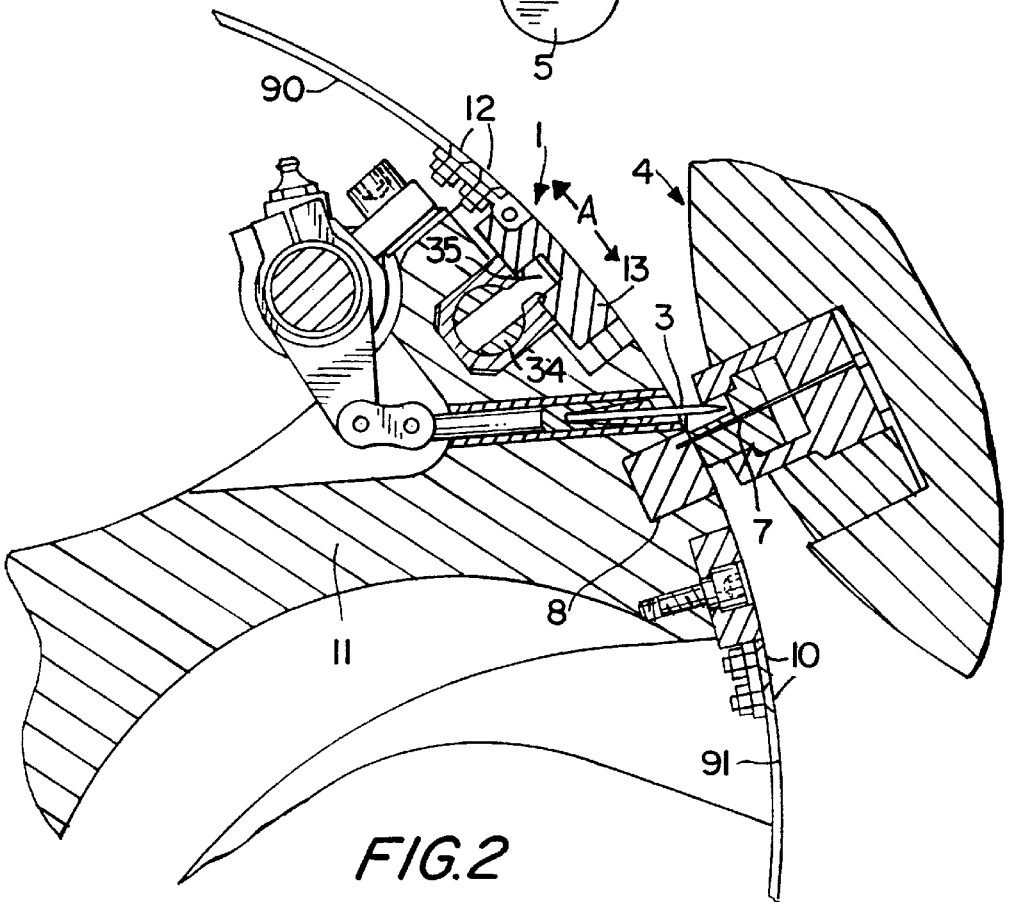
FIG. 2 shows an enlarged section from FIG. 1.
Figure 6:
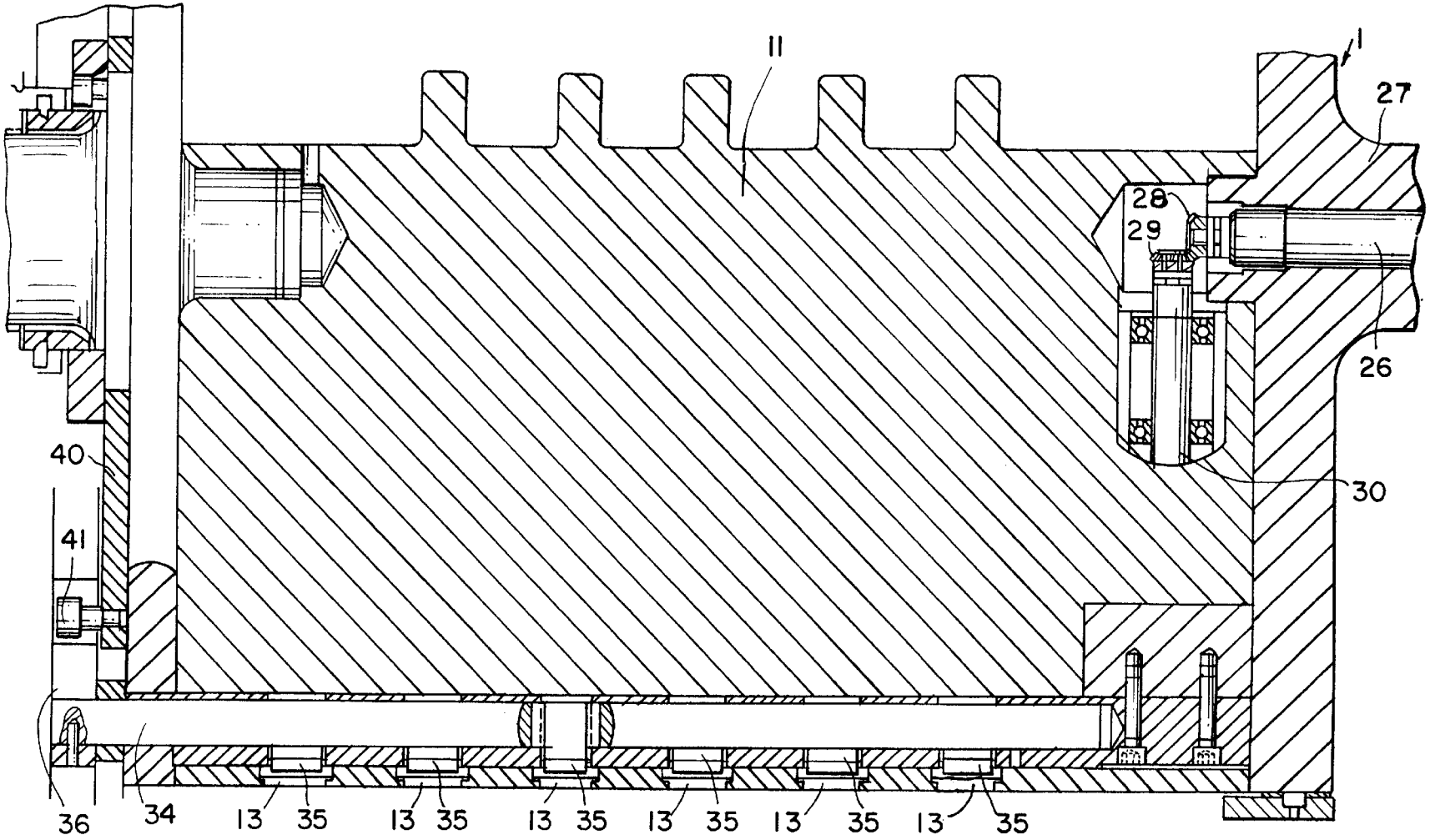
FIG. 6 shows a partial longitudinal section through the cylinder.

A collecting and folding-blade cylinder 1 (FIGS. 1, 2) has, on its circumference, three rows of folding blades 2 and three rows of awls 3. The awls 3 receive sheets for folding which are cut into portions by a cutting cylinder 4 cooperating with the collecting and folding-blade cylinder 1. The sheets which are held on the circumference of the collecting and folding-blade cylinder 1 by means of the awls 3 are then inserted by the folding blades 2 between two folding rollers 5, 6, which fold the sheets by passing the sheets between the rollers 5, 6. The cutting cylinder 4 (FIG. 2) has two cutting knives 7, each of which executes a cutting motion against a cutting shoulder 8 which is arranged at the jacket surface of the collecting and folding-blade cylinder 1 so that a web of printing stock is cut into sheets which are skewered by the awls 3. So that the collecting and folding-blade cylinder 1 can collect and fold sheets of different thickness, the circumference of the collecting and folding-blade cylinder 1 can be changed in that strips 90–92 are stretched or curved out. Six strips 90–92 lie adjacent to one another in each of the three circumferential portions (see FIG. 6) of the cylinder 1. The strips 90–92 span open regions in which the folding blades 2 move upon spindles, the folding blades 2 being moved out of the collecting and folding-blade cylinder 1 to produce the fold between the strips 90–92. The strips 90–92 are securely connected at one end edge with the cylinder body of the collecting and folding-blade cylinder 1, e.g., by screws 10. At their other end edge, the strips 90–92 are connected, e.g., also by screws 12, with connecting links 13 which are displaceable in the direction indicated by the double arrow A and which are supported in the cylinder body 11 in a sliding manner.

Figure 3:
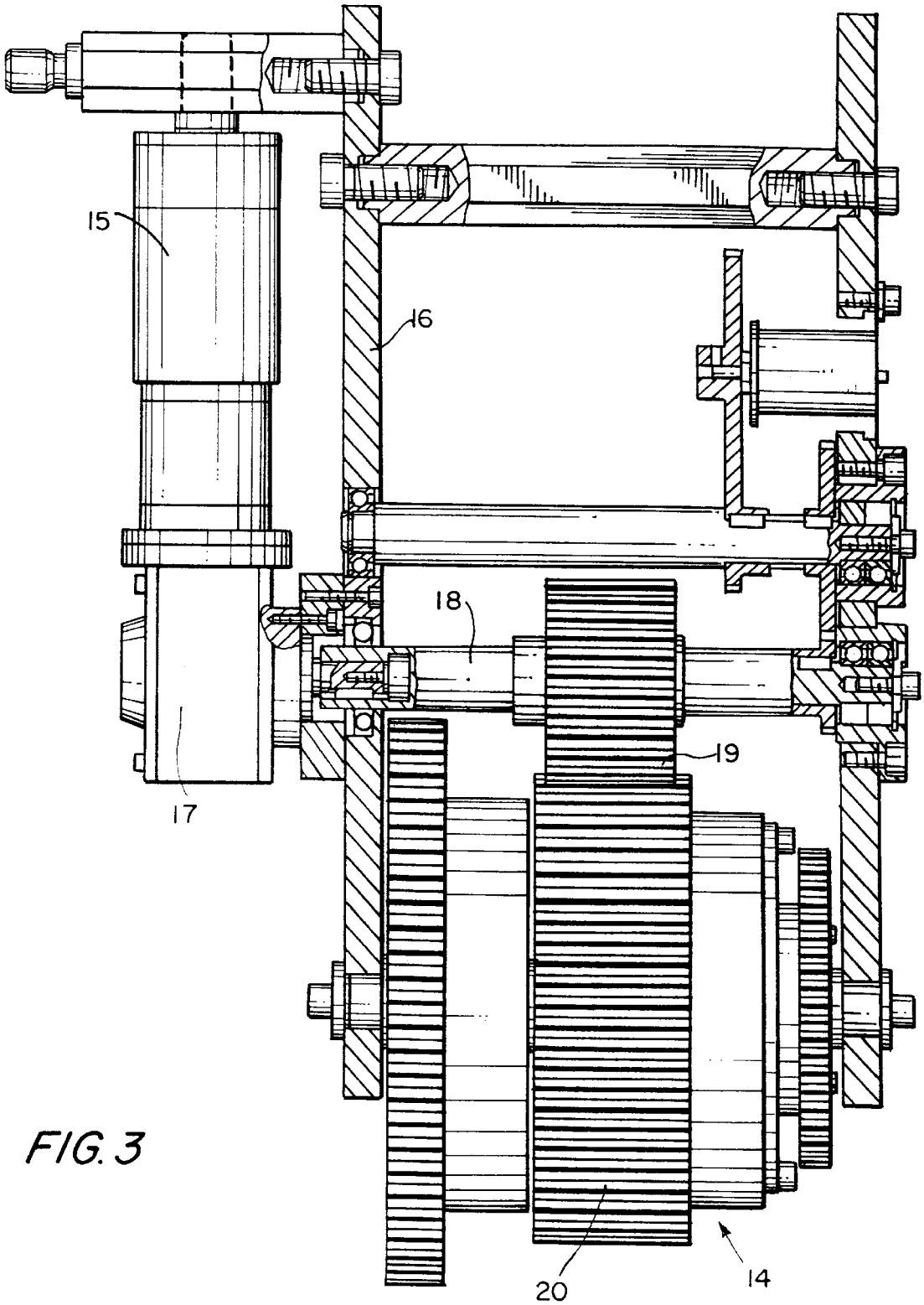
FIG. 3 shows a top view of a driving motor for adjusting the diameter and a portion of the associated driving mechanism.

In order to displace the connecting links 13 while the collecting and folding-blade cylinder 1 is running as well as when it is stopped, a drive (FIG. 3) is provided which superimposes an additional adjusting movement on the rotational movement of the collecting and folding-blade cylinder 1 by means of a planetary gear 14, the connecting links 13 being displaced by this additional adjusting movement. The drive has an electric motor 15 which is fastened to the side wall 16 of the folding mechanism. The electric motor 15 transmits its rotational movement to a shaft 18 via a gear unit 17. A toothed wheel 19 which meshes with a sun wheel 20 of the planetary gear 14 is fastened to the shaft 18.

Figure 4:
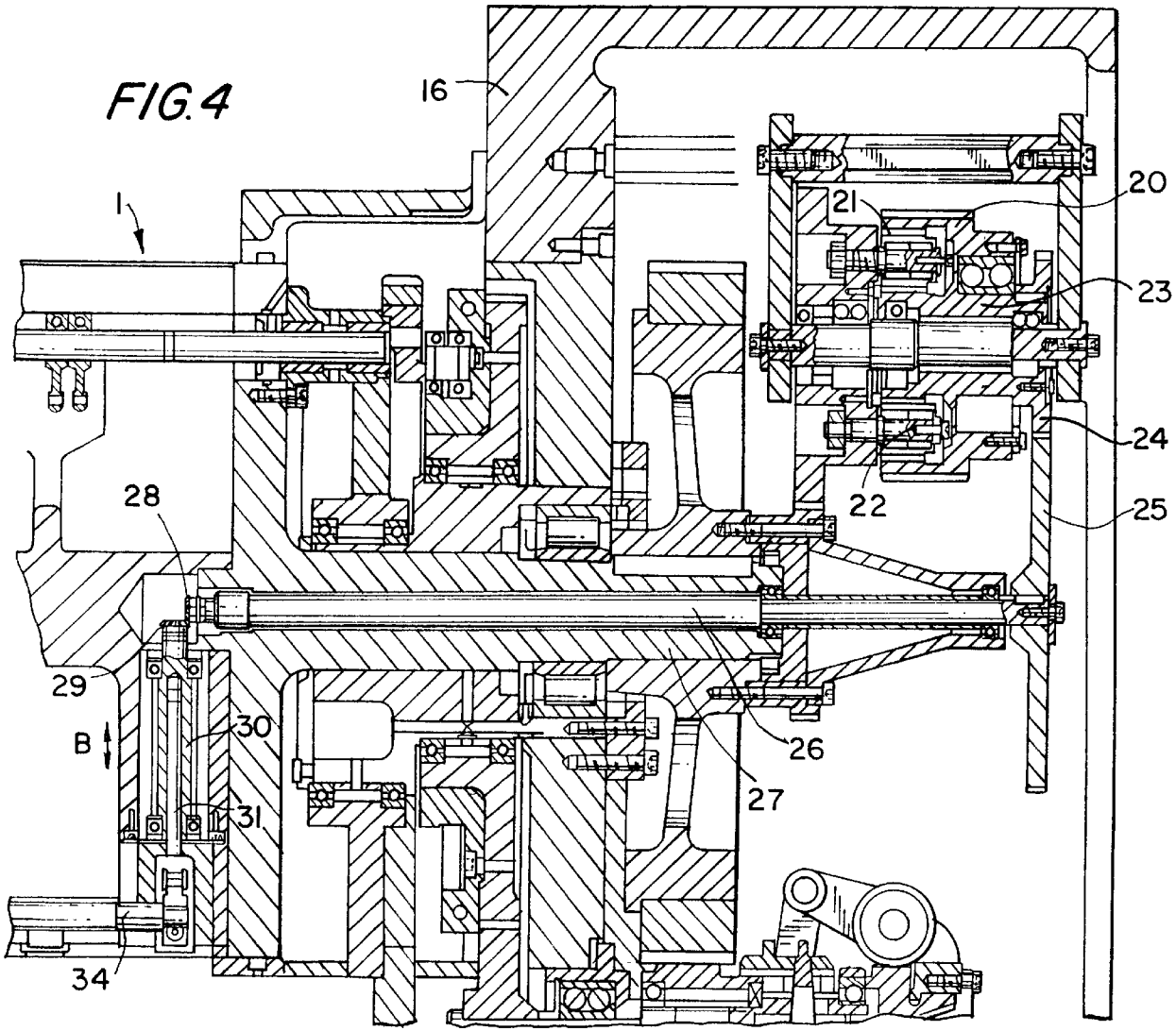
FIG. 4 shows a sectional view of another part of the driving mechanism in connection with the spindles for transmitting the pushing motion to the strips of the cylinder, which is shown in partial longitudinal section.

The sun wheel 20 (FIG. 4) drives planetary gears 22 via its internal toothing 21. The planetary gears 22 mesh with a hollow shaft 23 at whose end is arranged a driven toothed wheel 24. The wheel 24 drives a driving toothed wheel 25 of a spindle 26 which is arranged concentrically in the center of the drive shaft 27 of the collecting and folding-blade cylinder 1. The drive shaft 27 is also designed as a hollow shaft. The spindle 26 is drivingly connected to a spindle 30 via connecting means which include bevel gears 28, 29. The spindle 30 is arranged in the radial direction within the collecting and folding-blade cylinder 1. The spindle 30 forms within its interior a threaded sleeve for a threaded spindle 31. The rotational movement of the spindle 30 is transformed via its internal thread into a transverse movement of the threaded spindle 31 in the direction indicated by the double arrow B.

Figure 5:
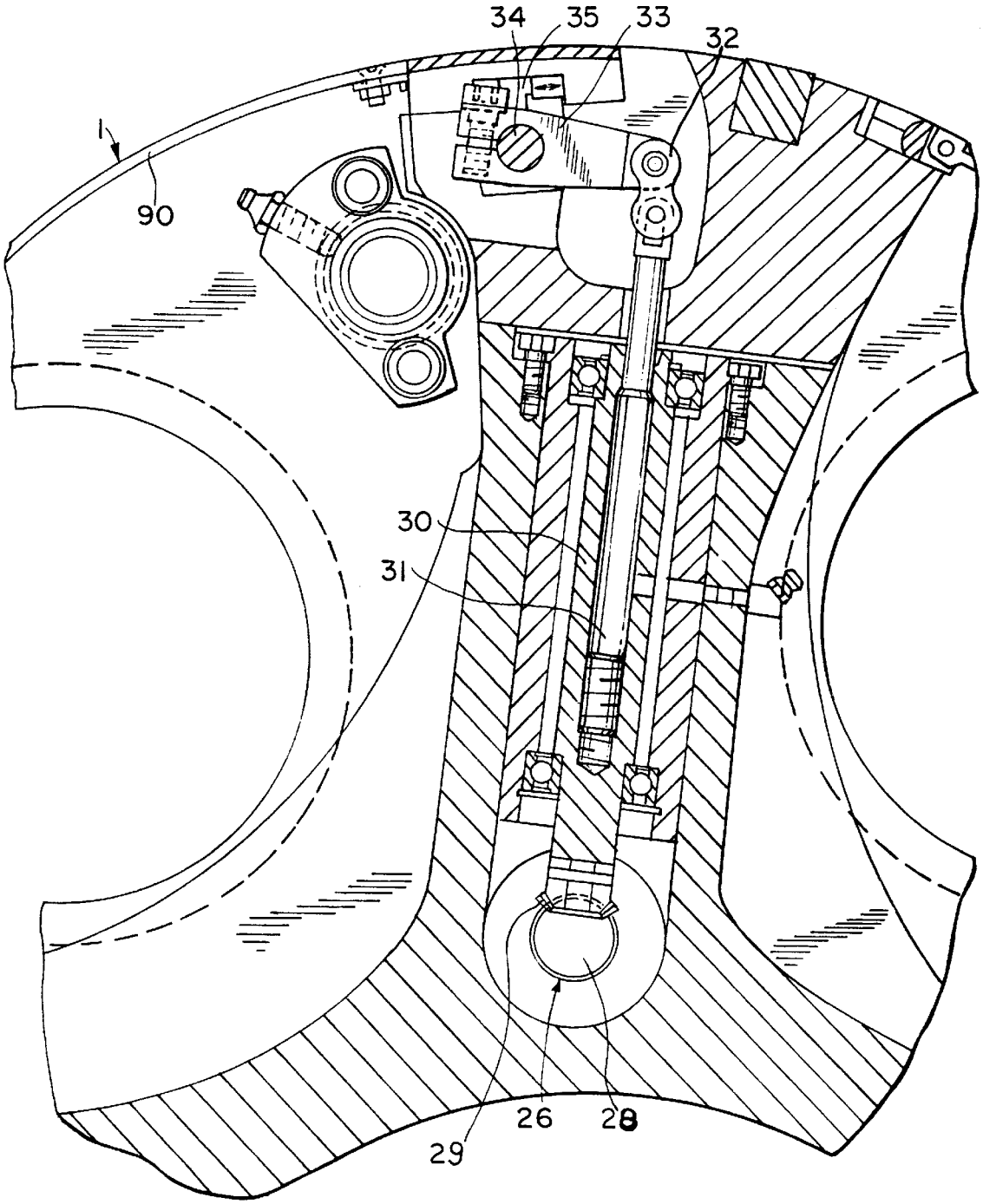
FIG. 5 shows a section from the cross section of the cylinder.

A chain link 32 is articulated at one end to the threaded spindle 31 (FIG. 5). The chain link 32 is fastened at its other end to a lever 33 which is supported so as to be rotatable about a spindle 34. A cam 35 is arranged on the upper side of the spindle 34. When the lever 33 and, along with it, the spindle 34 are rotated by a lifting movement of the chain link 32, the cam 35 is also rotated somewhat in a corresponding manner and generates a pushing motion for the displacement of the connecting links 13. As a result of the displacement of the connecting links 13, the strip 90 is either stretched so that the outer circumference of the collecting and folding-blade cylinder 1 is decreased or is curved outward so that the outer circumference of the collecting and folding-blade cylinder 1 is increased. The connecting links 13 and the cams 35 form connecting means between the spindles and the strips.

Figure 7:
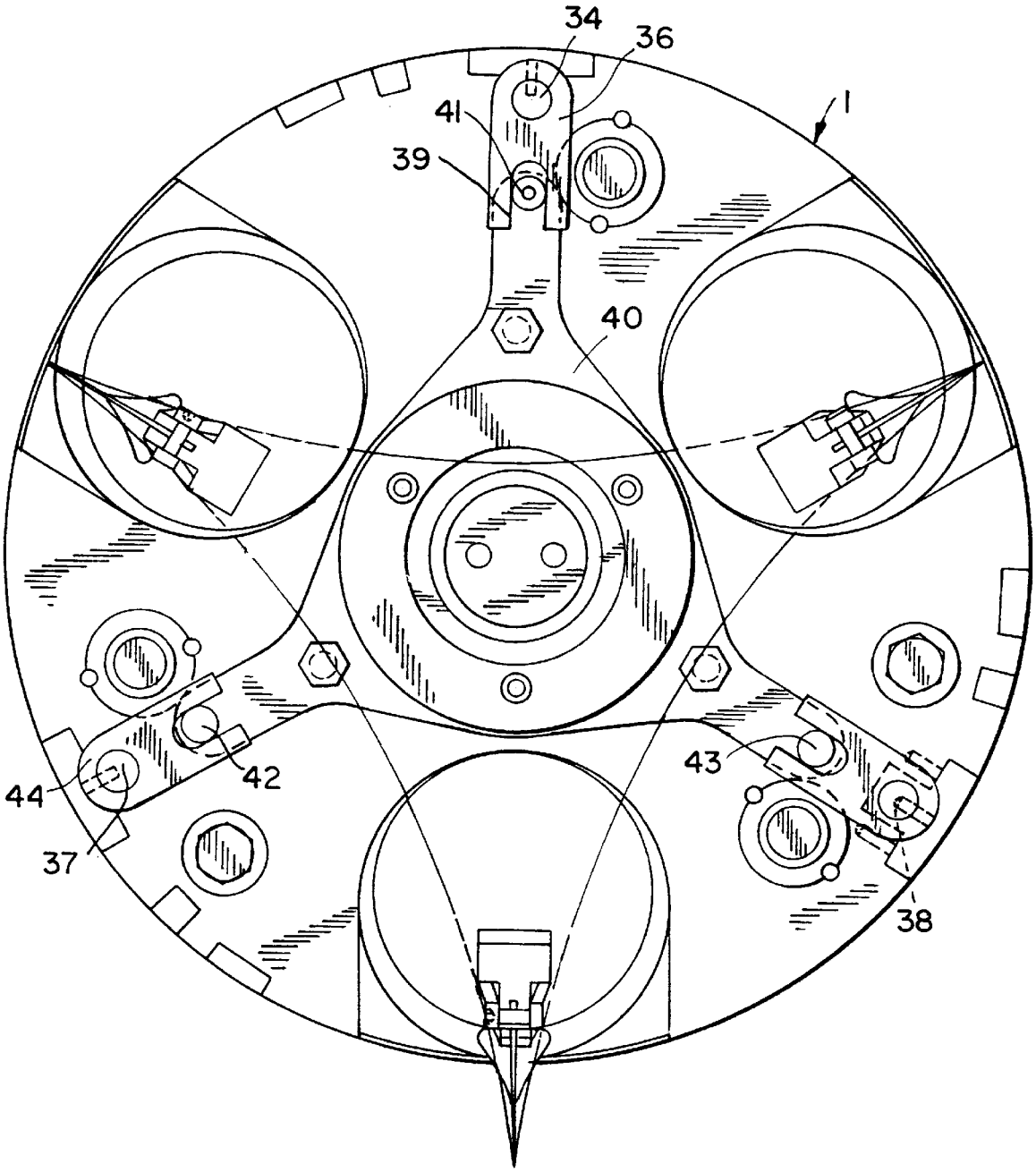
FIG. 7 shows an end view of the cylinder at the side which is not driven.

The spindle 34 (FIG. 6) penetrates the cylinder body 11 along its entire length and has a number of cams 35 corresponding to the number of strips 90 (six in the illustrated example). Accordingly, all strips 90 are simultaneously moved via the connecting links 13. The rotational movement of the spindle 34 is transmitted to two other spindles 37, 38 (FIG. 7) via a lever 36 which is fastened at the spindle 34 at the side of the collecting and folding-blade cylinder 1 which is not driven, the strips 91 and 92 being displaced via the connecting links 13 by means of these two other spindles 37, 38.

The lever 36 has a U-shaped recess 39 into which a pin 41 projects that is arranged on a transmitting disk 40. When the lever 36 is tilted by the rotation of the spindle 34, the tilting movement of the lever 36 is transformed via the pin 41 into a rotational movement of the transmitting disk 40. The disk 40 now moves the levers 44, 45 fastened at the spindles 37, 38 via corresponding pins 42, 43 so that these levers 44, 45 execute the same rotational movement as the spindle 34.

The movement mechanism which is shown in the preceding, only by way of example, can be replaced by different equivalent movement means. For instance, another type of superimposing gear unit, e.g., a differential gear such as that known from U.S. Pat. No. 5,313,883, can be used instead of the planetary gear 14. Instead of the hollow spindle 30 and the threaded spindle 31 arranged therein, a solid spindle which drives the spindle 34 at its driven end via a bevel gear can also be used. When the movable end edges of the strips 90–92 are fastened to the spindles 34, 37 and 38, their rotational movement can be transformed directly into a pushing motion of the strips 90–92.

The invention provides a simple, space-saving mechanism for adjusting the circumference of a cylinder, e.g., a collecting and folding-blade cylinder 1, which has an independent drive with an electric motor 15 and a superimposing gear unit, e.g., a planetary gear 14, whose rotational movement is transmitted to spindles 30 and 34 arranged in the cylinder via a spindle 26 which is drive shaft 27 of the cylinder. Their rotational movement is finally transformed by cams 35 and connecting links 13 into a transverse movement by which the strips 90–92 are either stretched so that the outer circumference of the cylinder is reduced or are curved out with respect to their circular contour so that its circumference increases.

The invention is not limited by the embodiments described above which are presented as examples only but can be modified in various ways within the scope of protection defined by the appended patent claims.

I claim:

1. An adjustable diameter cylinder for a folding mechanism to allow for different length folds, comprising:

a cylinder body formed as a hollow shaft and having a longitudinal axis and a cylinder jacket;

adjustment strips movably arranged on the jacket transverse to the longitudinal axis so as to change the cylinder diameter;

a first spindle mounted in the hollow shaft;

superimposing gear means for rotatably driving the first spindle;

a plurality of further spindles mounted in the cylinder body so as to be rotatable;

first connecting means for connecting the strips to the plurality of further spindles so that rotation of the further spindles moves the adjustment strips; and second connecting means for connecting the first spindle to the plurality of further spindles so that rotation of the first spindle imparts rotation to the plurality of further spindles which in turn move the strips transverse to the longitudinal axis so as to adjust the cylinder diameter while the cylinder is in operation.

2. A cylinder according to claim 1, wherein the superimposing gear means includes a planetary gear.

3. A cylinder according to claim 1, wherein the superimposing gear means includes a differential gear.

4. A cylinder according to claim 1, plurality of the further spindles include a second spindle arranged radially in the shaft, the connecting means includes first bevel gear means for drivingly connecting the first spindle which is arranged in the hollow shaft with the radial second spindle.

5. A cylinder according to claim 4, wherein the radial second spindle has an interior region formed as a threaded sleeve, plurality of the further spindles including a threaded third spindle operatively engaged in the threaded sleeve so as to transform rotational movement of the radial second spindle into a transverse, lifting movement of the threaded third spindle.

6. A cylinder according to claim 5, plurality of further spindles include a fourth spindle arranged below the jacket surface so as to extend parallel to the longitudinal axis of the cylinder, and further comprising a lever having a first end connected to the fourth spindle, and a second end, and a chain link having a first end connected to the second end of the lever, and a second end connected to the threaded third spindle so that the lifting movement of the threaded third spindle is transmitted via the chain link and the lever to the fourth spindle.

7. A cylinder according to claim 4, plurality of further spindles include a third spindle arranged below the jacket so as to extend parallel to the longitudinal axis of the cylinder, and further comprising second bevel gear means for drivingly connecting the radial second spindle with the third spindle so that rotation of the radial second spindle drives the third spindle.

8. A cylinder according to claim 6, wherein the first connecting means includes:

a plurality of connecting links slidably supported in the cylinder body below the jacket surface; and cam means connected between the fourth spindle, which extends parallel to the longitudinal axis of the cylinder, and the connecting links for transforming rotational movement of the fourth spindle into sliding movement of the connecting links, the strips having sliding end edges fastened to the connecting links.

9. A cylinder according to claim 7, wherein the first connecting means includes:

a plurality of connecting links slidably supported in the cylinder body below the jacket surface; and cam means connected between the third spindle, which extends parallel to the longitudinal axis of the cylinder, and the connecting links for transforming rotational movement of the third spindle into sliding movement of the connecting links, the strips having sliding end edges fastened to the connecting links.

10. A cylinder according to claim 6, wherein the end edges of the strips are fastened to the fourth spindle extending parallel to the longitudinal axis of the cylinder so that rotational movement of the fourth spindle can be transformed into a pulling and pushing motion of the strips.

11. A cylinder according to claim 7, wherein the end edges of the strips are fastened to the third spindle extending parallel to the longitudinal axis of the cylinder so that rotational movement of the third spindle can be transformed into a pulling and pushing motion of the strips.

12. A cylinder according to claim 6, wherein the plurality of further spindles includes spindles arranged below the jacket so as to extend parallel to the longitudinal axis of the cylinder, a number of the strips being associated with the spindles arranged below the jacket; and further comprising a transmitting disk arranged at one end of the cylinder and connected to the fourth spindle and the spindles arranged below the jacket so that rotational movement of the fourth spindle is transmitted to the spindles arranged below the jacket.

13. A cylinder according to claim 7, wherein the plurality of further spindles includes spindles arranged below the jacket so as to extend parallel to the longitudinal axis of the cylinder, a number of the strips being associated with the spindles arranged below the jacket; and further comprising a transmitting disk arranged at one end of the cylinder and connected to the third spindle and the spindles arranged below the Jacket so that rotational movement of the third spindle is transmitted to the spindles arranged below the jacket.

* * * * *